US005104335A

United States Patent [19]

Conley et al.

[11] Patent Number: 5,104,335

[45] Date of Patent: Apr. 14, 1992

[54] ELECTRICAL CORD CONNECTOR AND RETAINER

[76] Inventors: Paul M. Conley, W279 N2862 Rocky Point Rd., Pewaukee, Wis. 53072; Richard J. Kurz, N29 W27438 Peninsula Dr., both of Pewaokee, Wis. 53072

[21] Appl. No.: 665,018

[22] Filed: Mar. 5, 1991

[51] Int. Cl.[5] ..... H01R 13/62

[52] U.S. Cl. ..... 439/369; 439/373

[58] Field of Search ..... 439/368, 369, 371, 373, 439/452, 470, 471

[56] References Cited

U.S. PATENT DOCUMENTS

| | | | |
|---|---|---|---|
| 3,475,716 | 10/1969 | Laig | 439/369 |
| 3,999,828 | 12/1976 | Howell | 439/369 |
| 4,440,465 | 4/1984 | Elliott et al. | 439/369 |
| 4,484,185 | 4/1984 | Graves | 439/373 |
| 4,898,542 | 3/1990 | Jones, Jr. | 439/369 |
| 4,957,450 | 4/1990 | Pioszak | 439/369 |
| 5,011,427 | 4/1991 | Martin | 439/373 |

*Primary Examiner*—Larry I. Schwartz
*Assistant Examiner*—Hion D. Vu
*Attorney, Agent, or Firm*—Andrus, Sceales, Starke & Sawall

[57] ABSTRACT

An electrical cord connector includes a strap which is adapted to be placed over an extension cord, the strap having a plurality of retaining slots which are designed to receive a tab from a retaining member secured to a receptacle, whereby the plug end of the extension cord may be inserted in and secured to the receptacle by the strap and tab assembly. The cord connector and retainer is equally well suited for securing the plug either to a standard wall receptacle or to a second extension cord.

3 Claims, 2 Drawing Sheets

FIG. 5
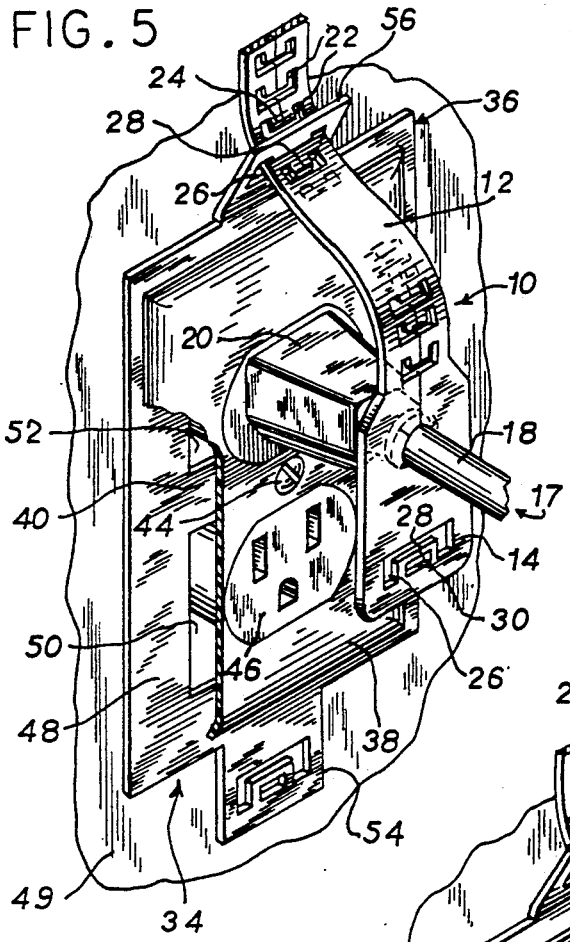
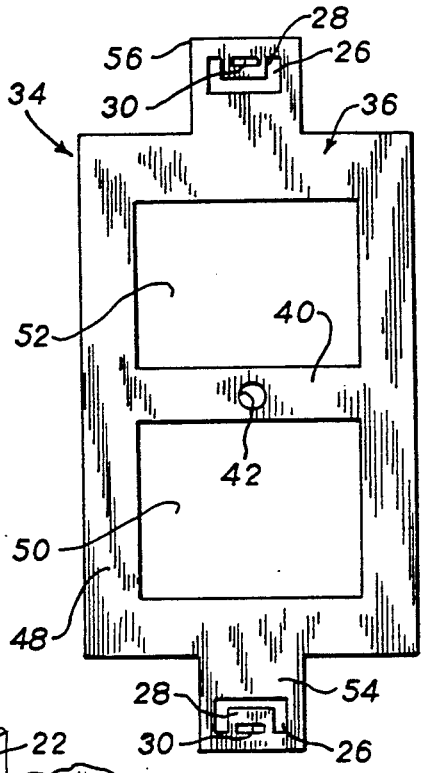
FIG. 6
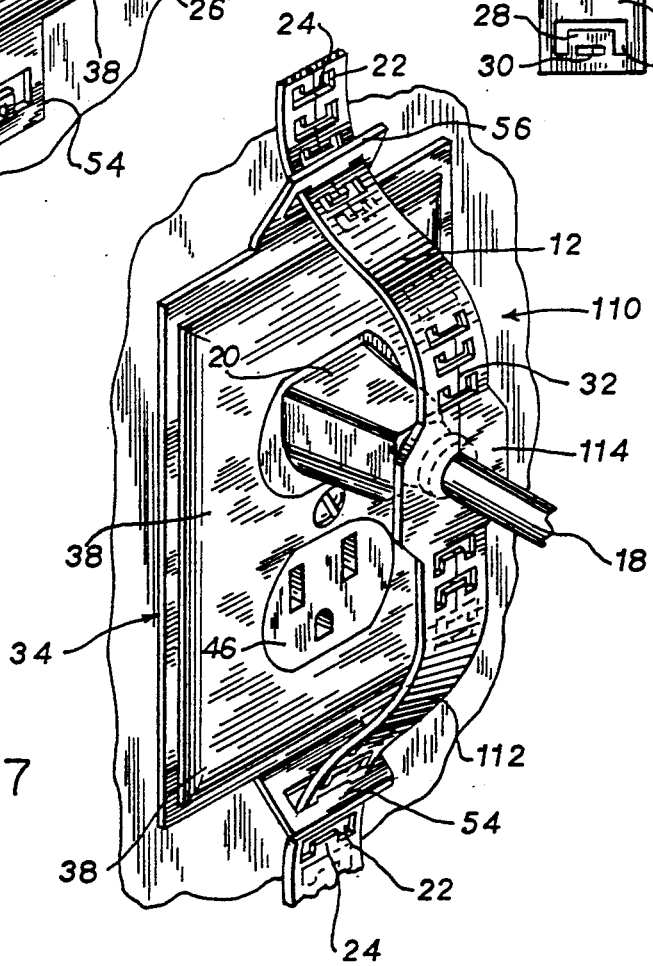
FIG. 7

ELECTRICAL CORD CONNECTOR AND RETAINER

BACKGROUND OF THE INVENTION

1. Field of the Invention

The subject invention is related generally to means for securing an electrical plug in a receptacle, and is specifically directed to means for securing and retaining the plug of an electrical cord in a wall receptacle or, in the alternative, in coupled relationship with the receptacle of a second electrical cord such as an extension cord or the like.

2. Description of the Prior Art

Over the years, a number of devices have been provided for securing standard electrical connectors in typical wall receptacles. For example, U.S. Pat. No. 2,895,119 issued to M. B. Montgomery on July 14, 1959 discloses a modified face plate having a slot adjacent the duplex receptacle and used in combination with a modified plug having a cover containing a detent tab which may be releasably retained in the slot for holding the plug in the receptacle.

U.S. Pat. No. 4,484,185 issued to J. D. Graves on Nov. 20, 1984 discloses a modified wall plate having means for securing a fuse box which is adapted for receiving a standard plug. A strap is provided on the box to retain the plug in the box adaptor.

U.S. Pat. No. 4,566,185 issued to H. Bryan on Jan. 28, 1986 discloses a retainer which may be adhesively secured to a standard wall plate, the retainer including a plurality of straps having adhesive strips for surrounding and securing the plug in the receptacle.

U.S. Pat. No. 4,618,200 issued to D. Roberts et al on Oct. 21, 1986 discloses a restraint system including a post which is permanently secured to the wall receptacle. The post has serrated edges for receiving and retaining a guard cover which is placed over the electrical plug after the plug is inserted in the receptacle.

There are also a number of devices for securing a plurality of extension cords to one another for retaining the plug of one cord in the receptacle of another. Examples include U.S. Pat. No. 3,475,716 issued to L. C. Laig on Oct. 28, 1969 and U.S. Pat. No. 4,183,603 issued to R. Donarummo on Jan. 15, 1980. Each of these devices require that the cord coupler be mounted on the extension cord prior to assembly, and the retainer is a permanent part of the assembled extension cord.

U.S. Pat. No. 3,999,828 issued to R. D. Howell on Dec. 28, 1976; U.S. Pat. No. 4,440,465 issued to J. M. Elliott et al on Apr. 3, 1984; U.S. Pat. No. 4,514,026 issued to P. Herbert on Apr. 30, 1985; U.S. Pat. No. 4,690,476 issued to J. Morgenrath on Sept. 1, 1987; U.S. Pat. No. 4,907,984 issued to L. S. Keller on Mar. 13, 1990; and U.S. Pat. No. 4,927,377 issued to W. D. Bach on May 22, 1990 each disclose various securing and retaining means for coupling a pair of extension cords to one another.

U.S. Pat. No. 3,871,731 issued to P. A. LaCoursiere on Mar. 18, 1975 discloses a cage for containing the male plug, wherein the cage may be secured to the wall plate, or in the alternative, the cage may be adapted to receive the female receptacle portion of a second extension cord.

Each of the known devices of the prior art has a disadvantage of requiring either that the wall receptacle be modified, the male plug be modified, or that the device itself become a permanent part of the electrical assembly. Another drawback of these devices is that most are not readily adaptable to secure the plug in a wall receptacle and, in the alternative, secure a plurality of extension cords to one another after the extension cords have been coupled.

SUMMARY OF THE INVENTION

The subject invention provides for an electrical cord connector and retainer system which is equally suitable for securing and retaining a coupled pair of electrical cords to one another and, in the alternative, for securing and retaining an electrical cord plug in a standard wall receptacle.

In the preferred embodiment, the retainer is defined by a semi-rigid plastic strap having a hole which is large enough to accept typical cord but is smaller than the typical plug or receptacle end of the cord, whereby the retainer is held in place on the cord. The retainer is defined by an elongate strap with the cord receiving hole at or adjacent one end. An elongate through slit extends radially outwardly from the hole along the length of the strap, facilitating spreading of the strap to enlarge the hole so that the retainer may be placed over the plug of an existing extension cord.

The strap includes a plurality of spaced apart "U"-shaped through slots, the center of the "U" defining a semi-rigid tongue.

The receptacle portion of the assembly is provided with an extension piece having a through aperture for receiving the strap. The through aperture includes a small tab having a channel adapted for receiving the tongue of the "U"-shaped slot for engaging and securely holding the strap in the retaining tab. The tab may be secured to and extended outwardly from a base plate which is adapted to be secured in place behind a standard wall cover for a wall receptacle or, in the alternative, may be a portion of the strap. In the latter case, a second strap is secured on the opposite end of a second electrical cord. Each of the connector strap assemblies may be identical, whereby the strap of the plug end of one electrical cord may be secured in the retainer tab at the receptacle end of the second electrical cord, and the strap of the second electrical cord may be secured in the retainer tab of the plug end of the first extension cord providing a secure coupled assembly.

It is an object and feature of the subject invention to provide for an electrical cord connector and retainer which is readily adaptable for use with a standard wall receptacle or any of a plurality of electrical cords.

It is a further object and feature of the invention to provide for an electrical cord connector which may be quickly and securely engaged and disengaged in a plurality of positions for accommodating plugs and receptacles of varying size.

It is yet another object and feature of the subject invention to provide for an electrical cord connector assembly which may be readily manufactured from a single sheet stock of a semi-rigid plastic material.

Other objects, features and advantages of the invention will be readily apparent from the accompanying drawing and description of the preferred embodiment.

BRIEF DESCRIPTION OF THE DRAWING

FIG. 5 is a perspective view illustrating the use of the cord connector and retainer of the subject invention in combination with a standard wall receptacle.

FIG. 6 is a plan view of a base plate adapted for use with the standard wall receptacle of FIG. 5.

FIG. 7 is a perspective view of an alternative embodiment of the cord connector and retainer for retaining the plug and cord in a standard wall receptacle.

DETAILED DESCRIPTION OF THE PREFERRED EMBODIMENT

Figure 1:
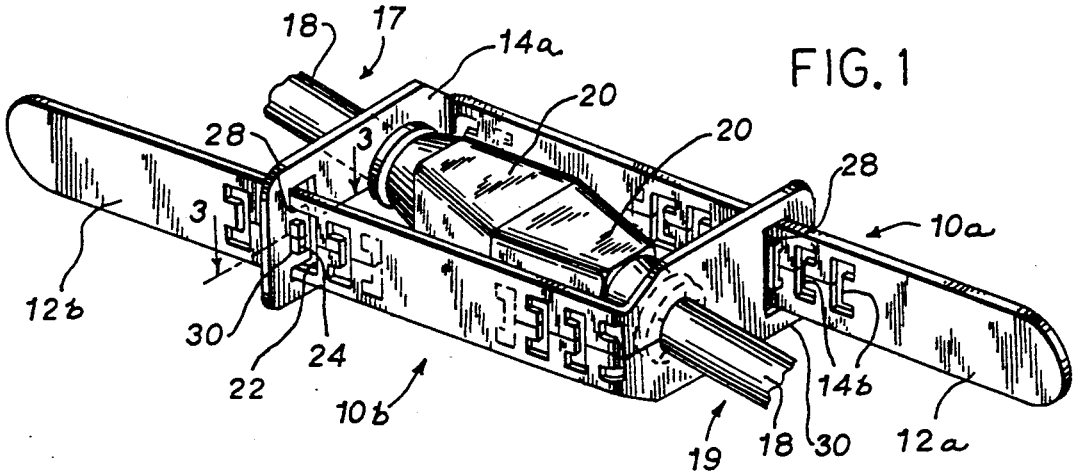
FIG. 1 is a perspective view of a cord connector and retainer in accordance with the subject invention and is shown as used for coupling a pair of electrical cords to one another.

In FIG. 1, the electrical connector and retainer of the subject invention is shown as used to connect a pair of electrical cords, such as, by way of example, extension cords 17, 19 to one another. As there shown, each connector 10*a*, 10*b* comprises an elongate strap 12*a*, 12*b* having a head portion 14*a*, 14*b*. As a matter of choice, the head portion 14 may be larger than the strap, but this is not necessary in the function of the invention. Each head 14*a*, 14*b* includes a through hole 16 which is large enough to receive a standard cord 18 of a typical extension cord 17, 19 but smaller than the extension cord end 20 containing either the female receptacle or the male plug. In typical use, the connector and retainer of the subject invention is well suited for coupling heavy duty outside extension cords to one another, wherein long runs are often required. However, it will be readily understood that the connector and retainer is readily adaptable to and equally well suited for use in other applications.

Figure 2:
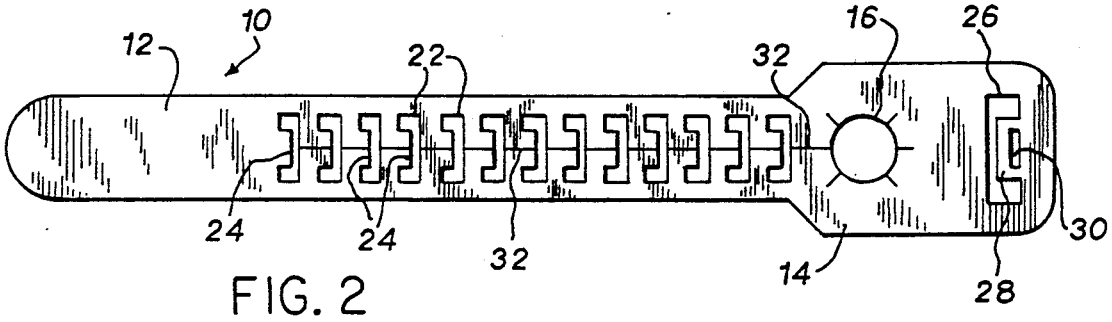
FIG. 2 is a plan view of the cord connector and retainer strap shown in FIG. 1.
Figure 4:
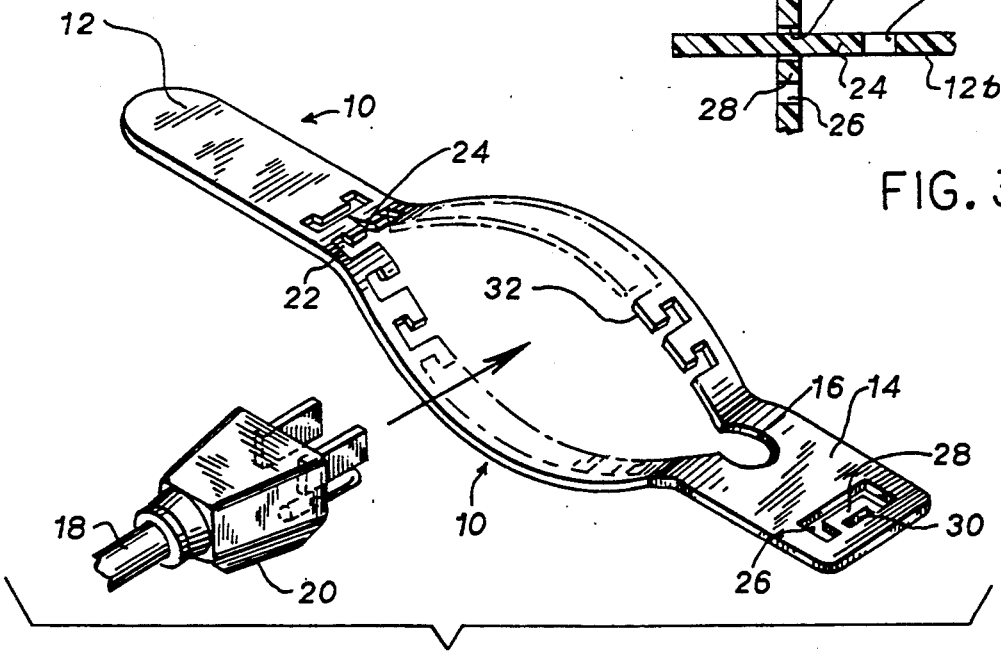
FIG. 4 is a perspective view of the cord connector and retainer strap shown in FIG. 1, illustrating the installation of the strap on an existing electrical cord.

As best shown in FIG. 2, the strap 12 of the connector and retainer includes a plurality of spaced apart "U"-shaped slots 22, each having a center tongue portion 24. The head 14 includes an enlarged "U"-shaped aperture 26 having a center tab 28. The center tab 28 includes a through channel 30 which is slightly larger than the dimensions of the tongue 24. The hole 16 for receiving the cord 18 of the typical extension cord assembly includes an elongate slit 32 extending radially outward from the hole generally along the centerline of the strap 12 and intersecting all or a portion of the slots 22. As shown in FIG. 4, the strap may be spread apart at the slit 32, whereby the enlarged end 20 of the extension cord may be inserted through the slit and the cord 18 may be placed into the receptive hole 16.

Figure 3:
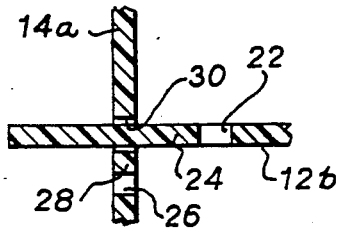
FIG. 3 is a partial view, in section, looking in the direction of arrows 3—3 of FIG. 1.

As is best shown in FIGS. 1 and 3, in order to couple the two extension cords 17, 19 to one another, a cord connector and retainer 10*a* is secured to each extension cord 17 and a like cord connector and retainer 10*b* is secured to extension cord 19. The slot 22 of one strap is inserted into the receptacle aperture 26 of the other, as shown in FIG. 1. The tongue 24 of the appropriate slot 22 is inserted in and retained in the through channel 30 of the tab 28, for engaging and securing the straps to one another for tightly holding the extension cords in coupled relationship.

The connector system of the subject invention is equally well suited for securing the plug end 20 of an extension cord 17 in a standard wall receptacle 34. As shown in FIG. 6, a base plate 36, made of substantially the same material as the connector strap 10, is adapted to be installed behind the typical wall cover 38 of the wall receptacle. A cross member 40 is provided in the base plate 36 and includes a hole 42 for receiving the mounting screw 44 which is used for securing the wall cover 38 to the duplex outlet 46. The outer perimeter 48 of the base plate is sandwiched between the wall 49 and the wall cover 38 to provide rigidity to the assembly. Clearance openings 50 and 52 accommodate the female sockets of the standard duplex receptacle 46. A pair of tabs 54, 56 are provided and extend outwardly from the base plate 36 and cover 38, as shown in FIGS. 5 and 6. Each tab includes the strap receptive aperture 26 having the tab 28 and a through channel 30 for receiving the strap portion 12 of the connector 10 and engaging the appropriate slots 22 and tongues 24, as is particularly shown in FIG. 5.

An alternative strap embodiment 110 is shown in FIG. 7, wherein the modified strap retainer includes a pair of straps 12 and 112, diametrically opposite the cord receptive hole 16 and a common centerline of the modified head 114. Each of the strap portions 12 and 112 include the plurality of slots 22, each having a tongue portion 24, and each of which is adapted to be received in the appropriate apertures 26 of the respective tab members 54, 56 of the base plate 36 for securing both sides of the connector in the base plate adaptor to provide a more secure retainer for holding the plug portion 20 of the extension cord 17 in the duplex receptacle 46.

While certain features and embodiments of the invention have been described herein, it will be readily understood that the invention includes all modifications and enhancements within the spirit and scope of the accompanying claims.

What is claimed is:

1. An electrical cord connector of the type for securing and retaining a pair of extension cords together, comprising:

a. a first elongate semi-rigid strap having a centerline and a head, the head including means for securing the strap to one of said cords adjacent a plug thereof;

b. a second elongate strap having a centerline and a head, the head including means for securing the strap to the cord of the second extension cord adjacent to a receptacle thereof, the means for securing the strap to the cord in said first and second elongate straps comprising a through hole in the respective head which is larger than the respective cord but smaller than the respective receptacle and plug, and an elongate through slit extending radially outward from the hole along the centerline of the respective strap, whereby each of said straps may be spread to facilitate installation and removal of said strap from each of said respective cords;

c. each of said straps including a plurality of through slots spaced along said centerline, each of said slots being substantially "U"-shaped in cross section, with the center portion of the "U" defining a tongue; and d. the head of each strap including a retaining means adapted for passing through one of the slots in said other elongate strap, wherein the tab in each said head is dimensioned to fit into the respective slot, each tab including a through aperture adapted for receiving and engaging the center tongue portion of the respective "U"-shaped slot.

2. The cord connector of claim 1, wherein said slit intercepts each of said "U"-shaped slots.

3. An electrical cord connector for securing a plug at the end of a flexible cord to a standard wall receptacle having a removable wall cover, the assembly comprising:

a. a first elongate, semi-rigid strap having a centerline and a head, the head including means for securing the strap to the cord adjacent to the male plug;

b. a plurality of through slots in the strap, spaced along said centerline, each of said slots being substantially "U"-shaped, the center of the "U" defining a tongue; and c. retaining means comprising a flat base plate adapted to be placed behind and securely held by the wall cover of the wall receptacle, the base plate including at least one retaining tab extending outwardly therefrom and outwardly from said wall cover for engaging a slot in said strap when the plug is inserted in the receptacle.

* * * * *